US007913867B2

(12) United States Patent
Phillips

(10) Patent No.: US 7,913,867 B2
(45) Date of Patent: Mar. 29, 2011

(54) LID, IN PARTICULAR FOR A DISPOSABLE CUP

(75) Inventor: Robert Phillips, East Sussex (GB)

(73) Assignee: Conopco, Inc., Englewood Cliffs, NJ (US)

( * ) Notice: Subject to any disclaimer, the term of this patent is extended or adjusted under 35 U.S.C. 154(b) by 1448 days.

(21) Appl. No.: 10/567,387

(22) PCT Filed: Aug. 6, 2004

(86) PCT No.: PCT/GB2004/003416

§ 371 (c)(1),
(2), (4) Date: Feb. 7, 2006

(87) PCT Pub. No.: WO2005/014425

PCT Pub. Date: Feb. 17, 2005

(65) Prior Publication Data

US 2006/0226147 A1 Oct. 12, 2006

(30) Foreign Application Priority Data

Aug. 7, 2003 (GB) ..... 0318527.9

(51) Int. Cl.

| | |
|---|---|
| ***B65D 43/24*** | (2006.01) |
| ***B65D 51/04*** | (2006.01) |
| ***A47G 19/22*** | (2006.01) |
| ***A23F 3/34*** | (2006.01) |

(52) U.S. Cl. ..... 220/254.2; 220/825; 220/826; 220/212; 220/713; 229/404; 229/906.1; 426/77; 426/435; 99/322

(58) Field of Classification Search ..... 220/254.2, 220/254.3, 254.5, 713, 212, 712, 825, 826; 229/404, 906.1; 426/77, 80, 83, 435; 99/319, 321, 322, 8

See application file for complete search history.

(56) References Cited

U.S. PATENT DOCUMENTS

| | | | | |
|---|---|---|---|---|
| 2,308,241 | A | 1/1943 | Hogaboom, Jr. | |
| 3,861,284 | A | 1/1975 | Costello | |
| 4,412,629 | A * | 11/1983 | Dart et al. | 220/711 |
| 5,567,898 | A * | 10/1996 | Shalev | 84/418 |
| 5,806,408 | A | 9/1998 | DeBacker et al. | |
| 6,460,725 | B1 | 10/2002 | Portman | |
| 6,488,170 | B1 * | 12/2002 | Johnson | 220/254.2 |
| 6,575,323 | B1 * | 6/2003 | Martin et al. | 220/254.3 |
| 2003/0031759 | A1 | 2/2003 | Portman et al. | |
| 2004/0089678 | A1 * | 5/2004 | Martin | 222/556 |
| 2004/0200836 | A1 * | 10/2004 | Hierzer et al. | 220/257.1 |

FOREIGN PATENT DOCUMENTS

| | | |
|---|---|---|
| GB | 2 281 852 A | 3/1995 |
| GB | 2 368 333 A | 5/2002 |

OTHER PUBLICATIONS

International Search Report on Application No. PCT/GB2004/003416 dated Oct. 29, 2004.
GB Search Report on Application No. GB 0318527.9.

* cited by examiner

*Primary Examiner* — Anthony Stashick
*Assistant Examiner* — James N Smalley
(74) *Attorney, Agent, or Firm* — Gerard J. McGowan, Jr.

(57) ABSTRACT

A lid for a cup which provides for use of a beverage bag unit comprising a beverage bag and a drawstring connected to the beverage bag, the lid comprising: a flange for attachment to a cup; and a body unit comprising a body section including an aperture through which the drawstring is slideable, and at least one wing member operable to allow a user to squeeze and/or hold the beverage bag when in a raised position.

17 Claims, 11 Drawing Sheets

LID, IN PARTICULAR FOR A DISPOSABLE CUP

FIELD OF THE INVENTION

The present invention relates to a lid for a cup, in particular a disposable cup, which provides for use of a beverage bag unit comprising a beverage bag and a drawstring connected to the beverage bag, where a beverage product, in particular an infused beverage product, such as tea, is obtained by immersion of a beverage bag in a beverage liquid.

BACKGROUND OF THE INVENTION

Beverage products are commonly supplied for consumption in disposable cups, these cups often being provided with a lid to prevent spillage, such as when carried. Also, where the beverage product is a hot product, the lid acts to maintain the temperature of the beverage product.

Conventional lids are inadequate for use with beverage bag units, as the drawstring has to pass between the lid and the cup, thus breaking the seal as normally provided by the lid, and requiring the lid to be removed in order to remove the beverage bag on attainment of a beverage product at the required strength.

More recently, a lid has been developed for use with a tea bag which includes a cross-shaped slit through which the drawstring is threaded, such that, following a required infusion, the drawstring is drawn up through the slit to cause the tea bag to be drawn into the slit and be held captive thereby.

This lid still, however, suffers from a number of disadvantages. Notably, the drawstring has to be pre-threaded, both because it is particularly difficult to thread the drawstring through the slit, akin to threading the eye of a needle but where the slit does not present an aperture, and because the tab, which is provided to the drawstring to allow a user to raise the tea bag, has to be attached to the drawstring following threading. In addition, as the drawstring is a tight fit in the slit, the tea bag cannot be repeatedly dunked in the beverage, as required to obtain a strong infusion. Furthermore, in requiring the tea bag to be forcibly drawn up into the slit, the tea bag can be ruptured by the sharp edges of the slit, leading undesirably to the leakage of tea leaves into the cup, and the drawstring can even be separated from the tea bag, which could occur prior to the tea bag being held captive in the slit and lead to the tea bag remaining in the cup and providing for over-infused tea.

SUMMARY OF THE INVENTION

It is thus an aim of the present invention to provide an improved lid for use with a beverage bag unit, in particular a lid which allows for the drawstring of the beverage bag unit to be attached easily to the lid, and the beverage bag of the beverage bag unit to be squeezed and held clear of the beverage product on attainment of a beverage product at a required strength.

Thus, the present invention provides a lid for a cup which provides for use of a beverage bag unit comprising a beverage bag and a drawstring connected to the beverage bag, the lid comprising: a flange for attachment to a cup; and a body unit comprising a body section including an aperture through which the drawstring is slideable, at least one wing member which is hinged to the body section and operable, with the lid fitted to the cup, by a finger and/or thumb of a user to allow the user to squeeze and/or hold the beverage bag when in a raised position.

Preferably, the lid is provided with first and second wing members which are operable by ones of fingers or a finger and a thumb of a user.

Preferably, the flange is configured to provide a fluid-tight seal with a cup.

Preferably, the aperture is sized such that the drawstring is freely slideable therein.

Preferably, the beverage bag unit comprises a tab provided to the drawstring, and the aperture is sized such that the tab can be threaded therethrough.

Preferably, the body section includes a drinking spout. However, alternatively, a drinking spout may be formed by operation of one of the wing members.

Preferably, the at least one wing member is resiliently hinged to the body section.

In one embodiment there are two wing members hinged to a central region of the body section such as to be hinged in opposite senses on operation of the same.

Preferably, at least one wing member is attached to the body section by a hinge element about which the same is hinged on operation of the wing member, and a perforated connection which is broken on operation of the wing member.

Preferably, at least one wing member is recessed such as to receive a finger and/or thumb of the user.

In one embodiment at least one wing member comprises an engagement element which can engage another such element when the wing member is in a hinged configuration following squeezing of the beverage bag, such as to lock the wing member in the hinged configuration and thereby hold the beverage bag in a raised position.

Preferably, the engagement element on one wing member comprises a projection and the other such element comprises a recess, with locking being achieved by frictional engagement of the same.

Preferably, there are first and second wing members, and the wing members include counterpart engagement elements which engage one another when the wing members are in a hinged configuration following squeezing of the beverage bag, such as to lock the wing members in the hinged configuration and thereby hold the beverage bag in the raised position.

In another embodiment the body unit includes a drawstring locking element which provides for locking of the drawstring when the beverage bag is in the raised position, such as to hold the beverage bag in the raised position.

Preferably, the body unit comprises an upstanding wall member, a lower edge of which is connected to the flange, and a closure member which extends inwardly of an upper edge of the wall member and comprises the body section and the at least one wing member.

Preferably, the lid is integrally formed.

More preferably, the lid is vacuum formed from a plastics material.

In one embodiment the beverage bag unit comprises a tea bag unit.

Preferred embodiments of the present invention will now be described hereinbelow by way of example only with reference to the accompanying drawings, in which:

DETAILED DESCRIPTION OF THE INVENTION

Figure 1:
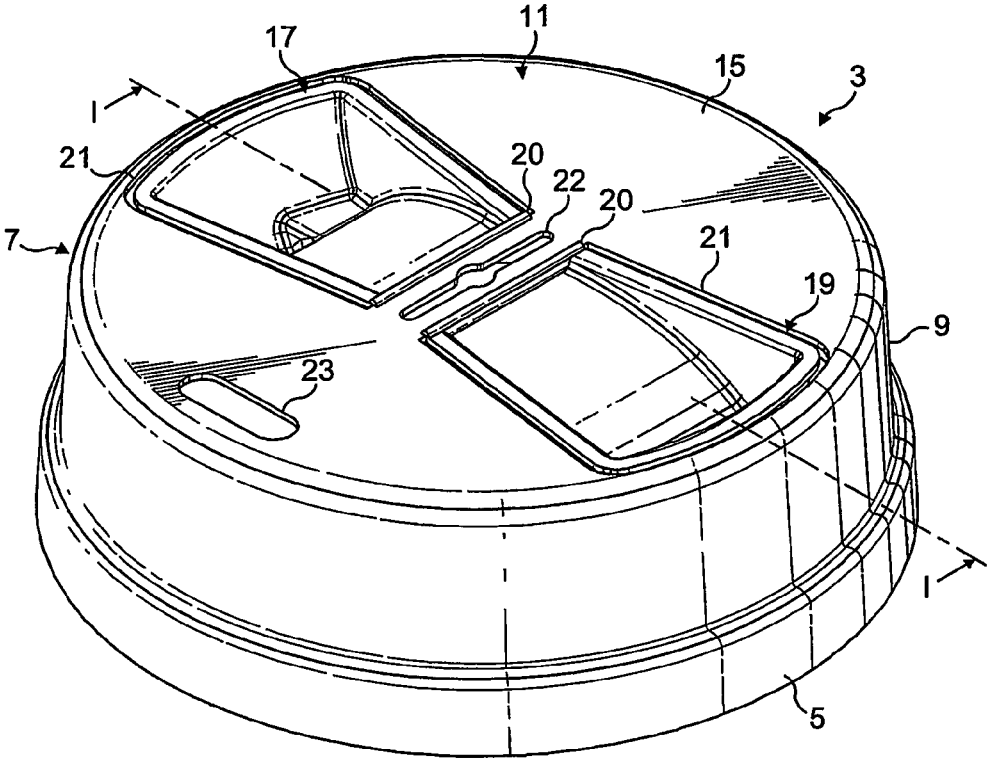
FIG. 1 illustrates a perspective view of a lid in accordance with a first embodiment of the present invention.
Figure 2:
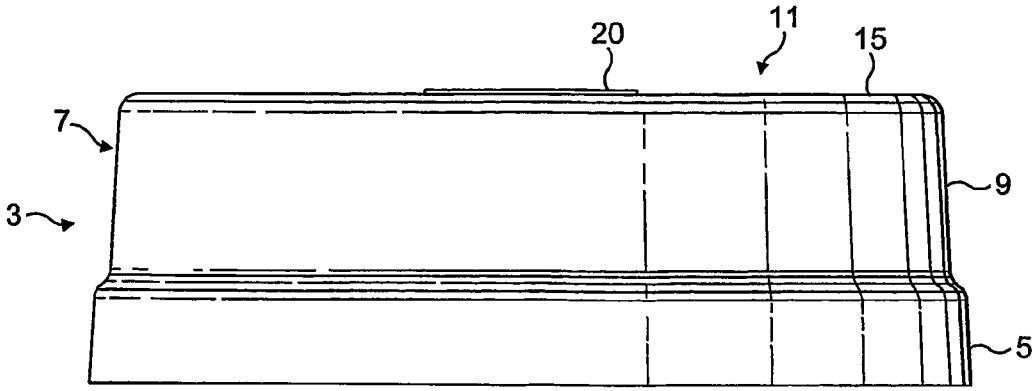
FIG. 2 illustrates a side view of the lid of FIG. 1.
Figure 3:
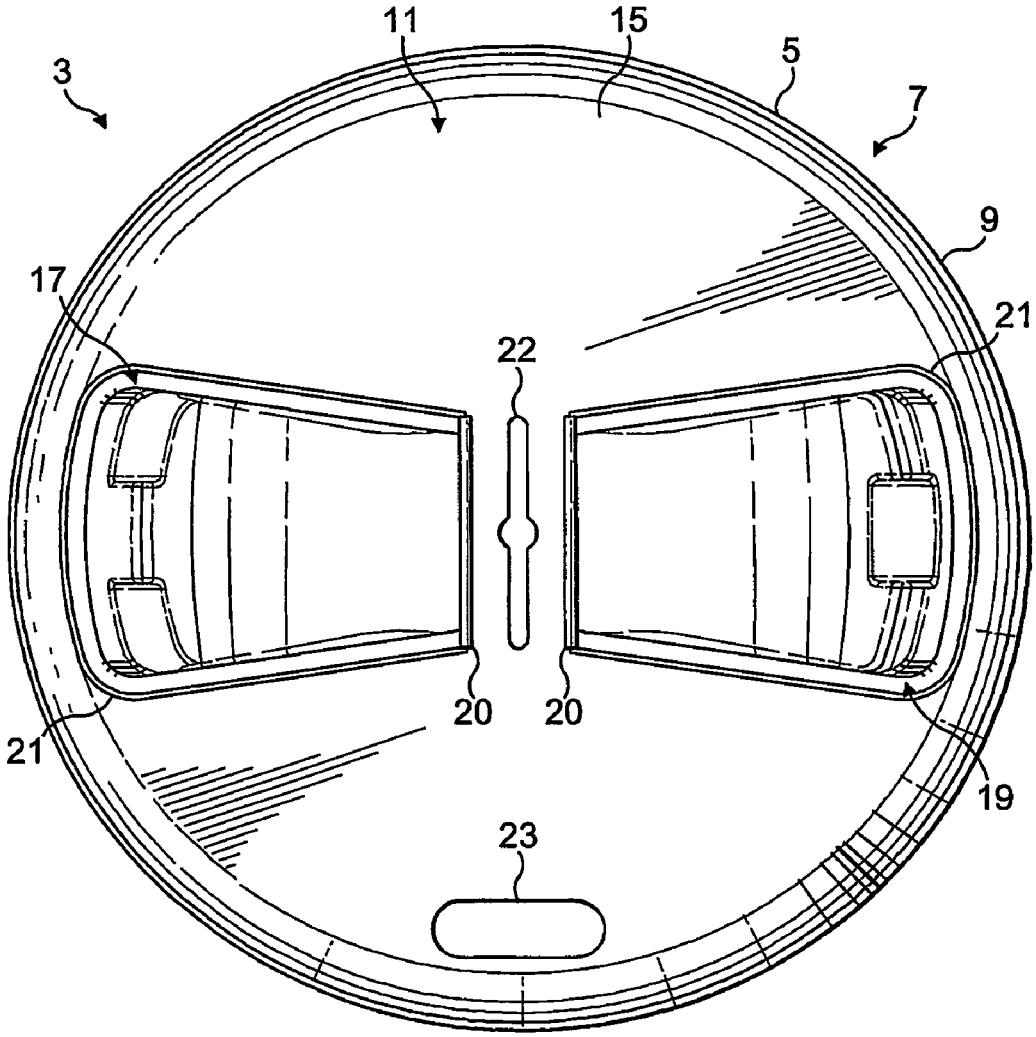
FIG. 3 illustrates a plan view of the lid of FIG. 1.
Figure 4:
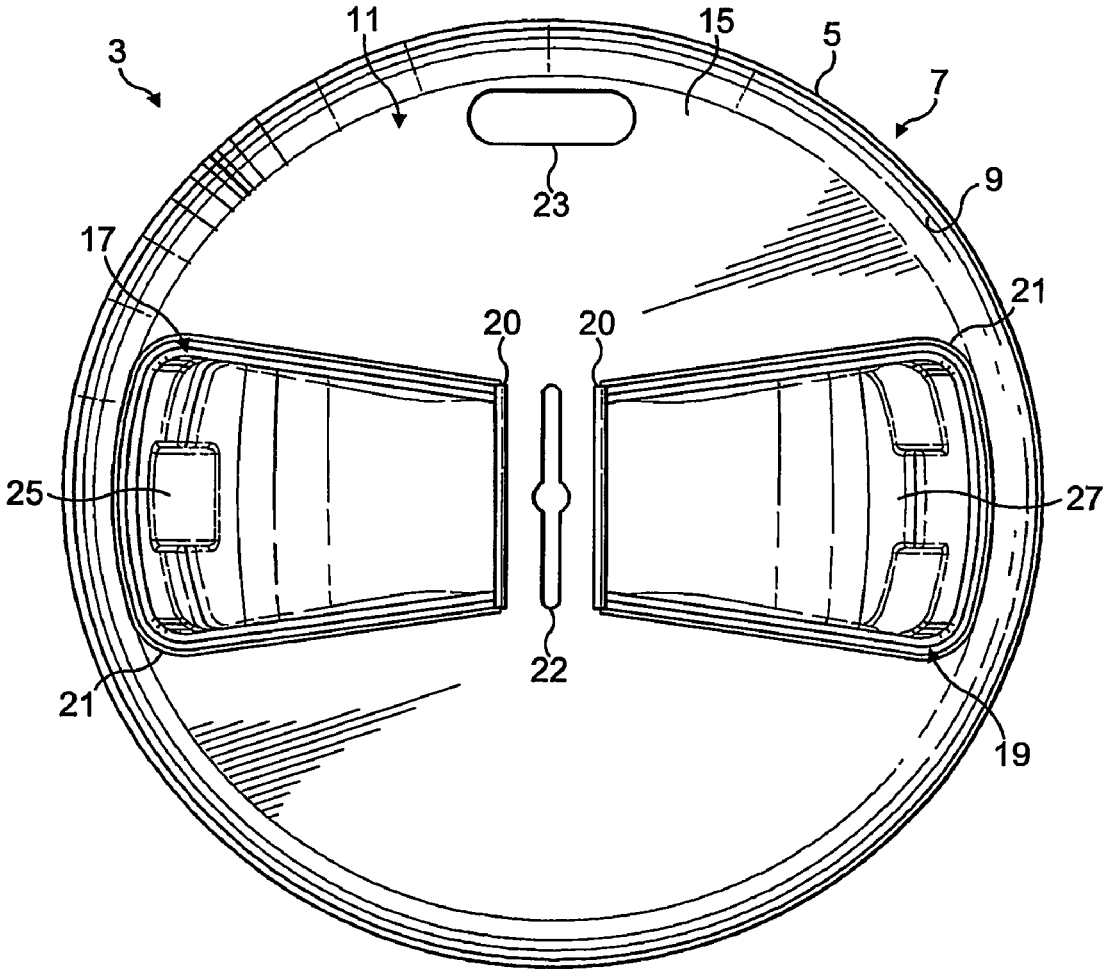
FIG. 4 illustrates an underside view of the lid of FIG. 1.
Figure 5:
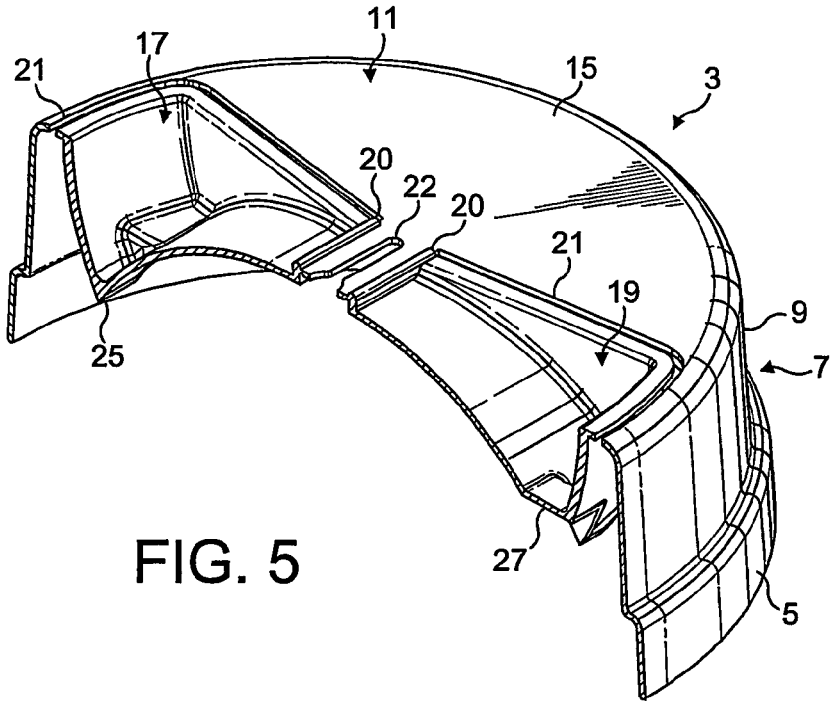
FIG. 5 illustrates a perspective sectional view (along section I-I) of the lid of FIG. 1.
Figure 6:
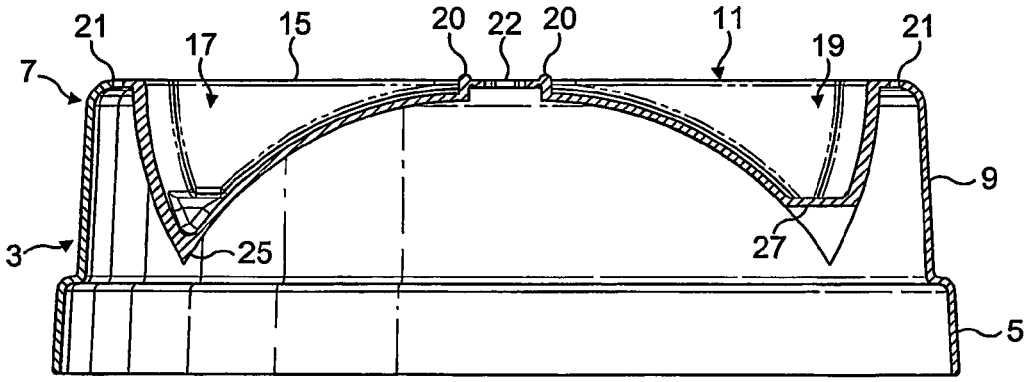
FIG. 6 illustrates a side sectional view (along section I-I) of the lid of FIG. 1.

The lid 3 comprises an annular flange 5 which is configured, in this embodiment dimensioned, to be a tight, sealing fit with the upper rim of an open-topped cup which contains a beverage product such as to prevent leakage at the junction of the flange 5 and the cup, and a body unit 7 which is formed integrally with the flange 5 and encloses the cup.

In this embodiment the lid 3 is formed from a plastics material, with the material being determined according to the beverage product. In a preferred embodiment the lid 3 is vacuum formed.

In this embodiment the body unit 7 comprises an annular wall member 9, a lower edge of which is formed with the flange 5, and a closure member 11 which extends inwardly of an upper edge of the wall member 9, here substantially parallel to the flange 5, and encloses the cup.

In this embodiment the wall member 9 has a height such that the beverage bag of a beverage bag unit can be maintained clear, or at least substantially clear, of the beverage product contained by the cup when full, as will become apparent hereinbelow.

The closure member 11 comprises a body section 15 and first and second wing members 17, 19 which are hingeable about respective hinges 20, in this embodiment resilient connections, to the body section 15 such as to allow a user to squeeze the beverage bag when raised from the beverage product and hold the beverage bag in a position raised from the beverage product to prevent further infusion when standing, as will be described in more detail hereinbelow. In this embodiment the junction of the wing members 17, 19 to the body section 15 at other than the respective hinges 20 is by a perforated connection 21, which connection 21 is broken on operation of the wing members 17, 19 by a user.

The body section 15 includes a slot 22, in this embodiment centrally thereof, through which the drawstring of a beverage bag unit is threaded. In this embodiment the slot 22 is configured such as to allow the tab on the drawstring to be threaded therethrough. This configuration advantageously allows beverage bag units to be attached to lids 3 either at the time of manufacture or as and when required at service points. Also, as a result of the drawstring being a free, sliding fit in the slot 22, a user can repeatedly dunk the beverage bag into the beverage liquid where a strong infusion is required.

The body section 15 further includes a drinking spout 23 at one edge thereof through which a user drinks the beverage product as contained In the cup.

In one embodiment, for example, where the beverage product is a hot product, the body section 15 can include a caution notice warning of the same, which notice can be vacuum formed into the body section 15 where the lid 3 is vacuum formed.

The wing members 17, 19 are hinged, in this embodiment to a central region of the body section 15, such that on operating the same, the wing members 17, 19 are hinged in opposite senses and encompass the beverage bag when located therebetween. In this embodiment the wing members 17, 19 are recessed to receive ones of fingers or a finger and a thumb, typically a forefinger and a thumb, to allow for operation by squeezing the same. The wing members 17, 19 include counterpart engagement elements 25, 27 which engage one another when the wing members 17, 19 are in the hinged configuration such as to lock the wing members 17, 19 in the hinged configuration, and thereby hold the beverage bag in the raised position following squeezing. In this embodiment the engagement element 25 on one, the first wing member 17 comprises a projection and the engagement element 27 on the other, second wing member 19 comprises a recess, with the locking being achieved by frictional engagement of the same.

In this embodiment the engagement elements 25, 27 are disposed centrally to the ends of the wing members 17, 19. In other embodiments the engagement elements 25, 27 can be disposed in any configuration, for example, off center, in dependence upon the design of the beverage bag.

A typical operation of the lid 3 in relation to a beverage bag unit 33 will now be described hereinbelow by way of example with reference to FIGS. 7(*a*) to (*c*) of the accompanying drawings.

The beverage bag unit 33 comprises a beverage bag 35 which contains beverage material, a drawstring 37 which is connected to the beverage bag 35 and a tab 38 which is provided to the drawstring 37 to allow for a user to handle the beverage bag unit 33. It will be understood that the present invention finds application in relation to any bagged beverage product, which, for example, includes tea and flavourings. Also the beverage liquid can be hot or cold, and can be other than water, for example, milk. For the purposes of illustration, the operation of the lid 3 will be described in relation to a tea bag unit, where infused by hot water.

A cup 39 is first filled with a beverage liquid 41, in this embodiment a hot water.

The beverage bag unit 33, In this embodiment a tea bag unit, is then attached to the lid 3 by threading the tab 38 through the slot 22 in the body section 15. In one embodiment the lid 3 can be supplied with the beverage bag unit 33 already pre-threaded thereto.

Figure 7A:
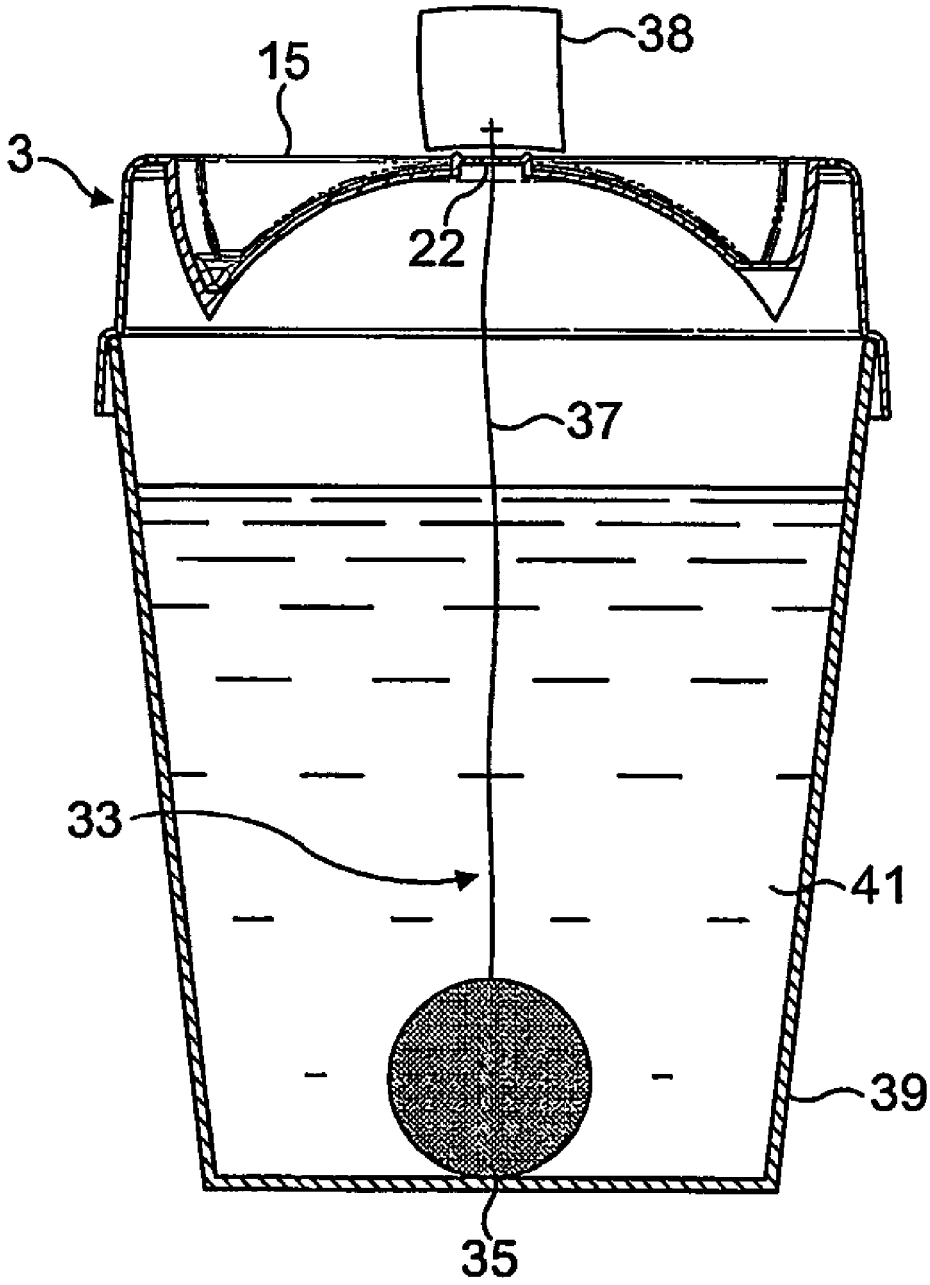
FIGS. 7(*a*) to (*c*) illustrate the operation of the lid of FIG. 1 in relation to a beverage bag unit.
Figure 7B:
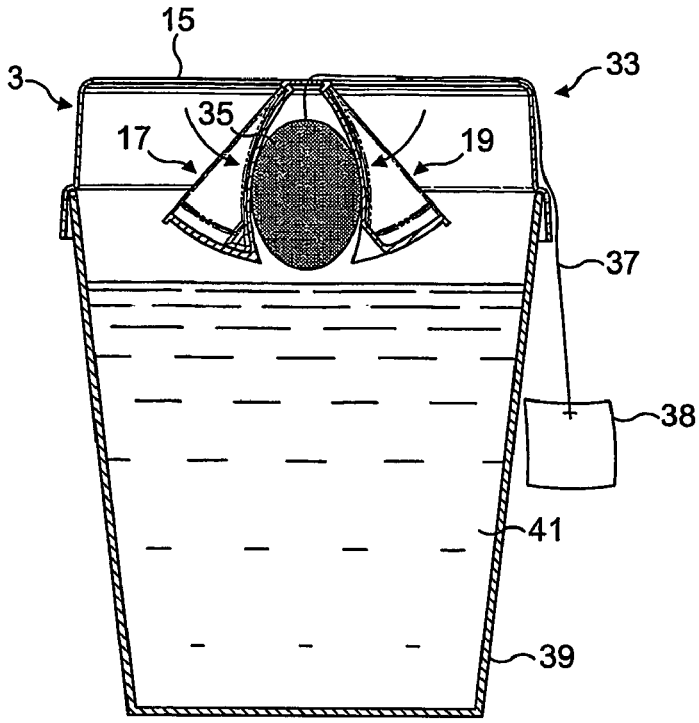
Figure 7C:
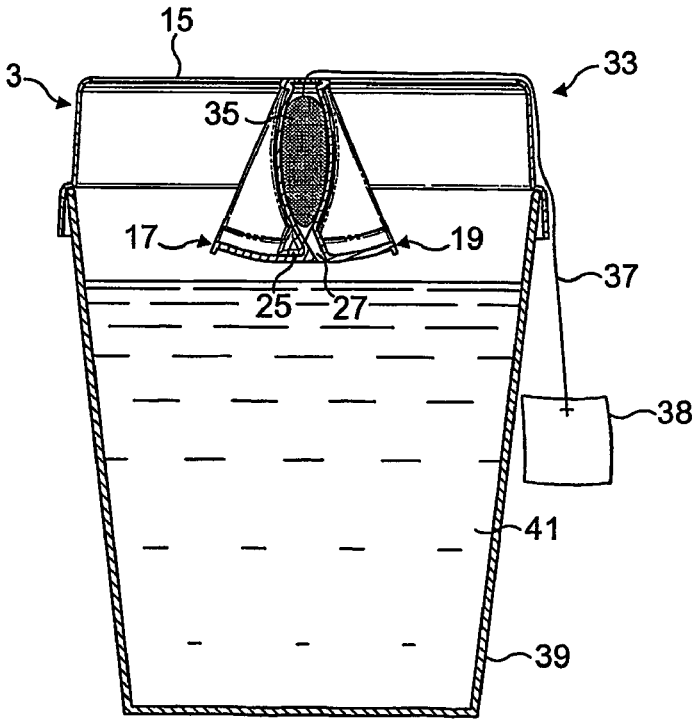

As illustrated in FIG. 7(*a*), the lid 3 is then fixed to the rim of the cup 39, whereupon the beverage bag 35 falls into the beverage liquid 41. The user can then dunk the beverage bag 35 as required to obtain a beverage product of the required strength.

On attainment of a beverage product at the required strength, the user draws up the beverage bag by raising the tab 38 and operates on the wing members 17, 19 first to squeeze the retained beverage liquid from the beverage bag 35, as illustrated in FIG. 7(*b*), and subsequently lock the wing members 17, 19 in the locked configuration through inter-engagement of the engagement members 25, 27 thereof, such as to hold the beverage bag 35 clear of the beverage product and prevent further infusion, as illustrated in FIG. 7(*c*).

Figure 8:
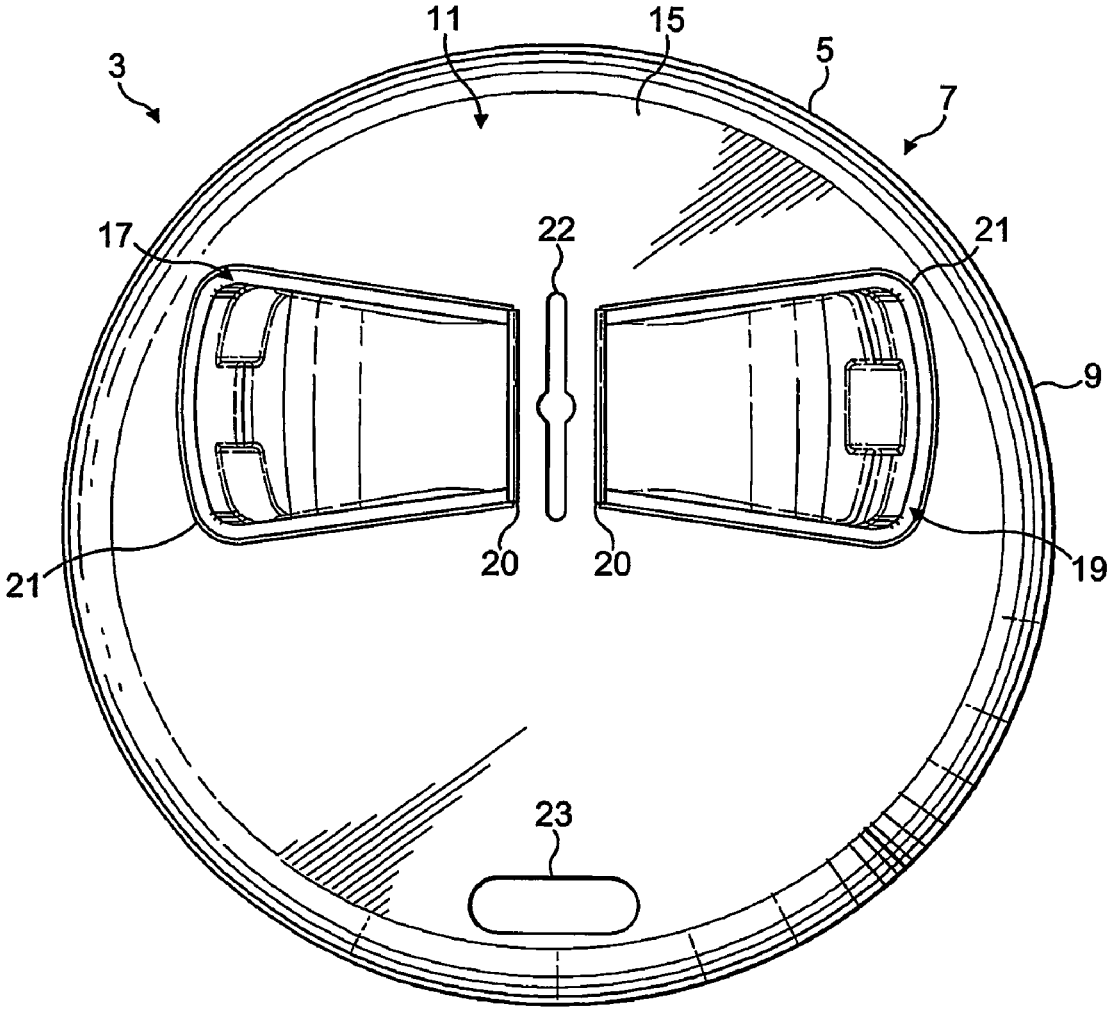
FIG. 8 illustrates a plan view of a lid as a modification of the lid of FIG. 1.
Figure 9:
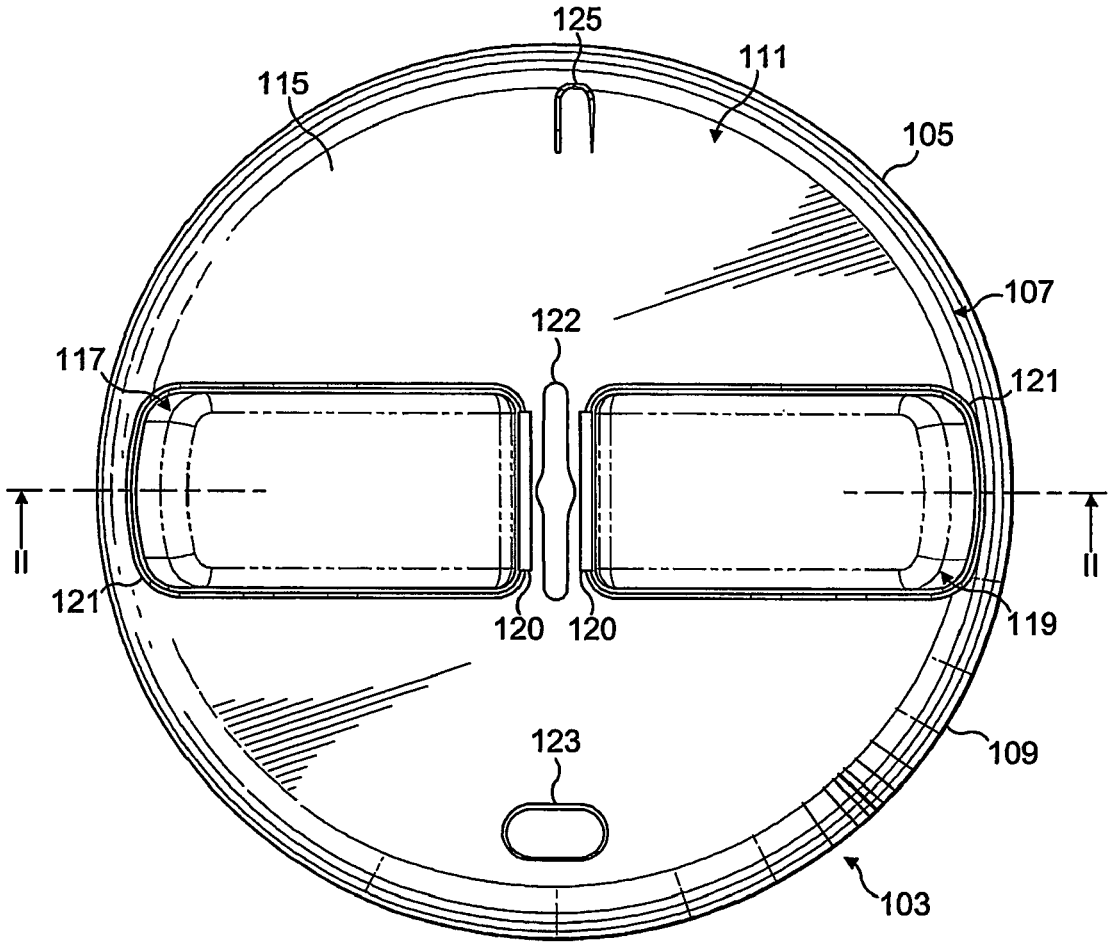
FIG. 9 illustrates a plan view of a lid in accordance with a second embodiment of the present invention.
Figure 10:
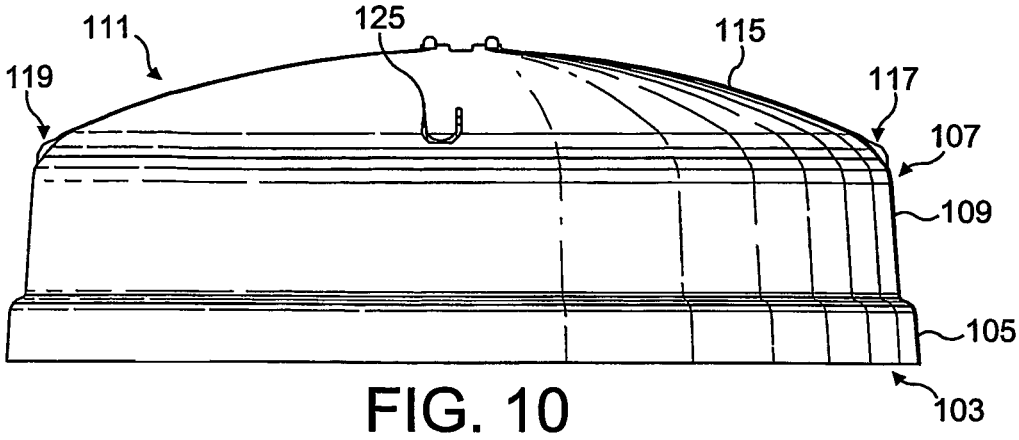
FIG. 10 illustrates one side view of the lid of FIG. 9.
Figure 11:
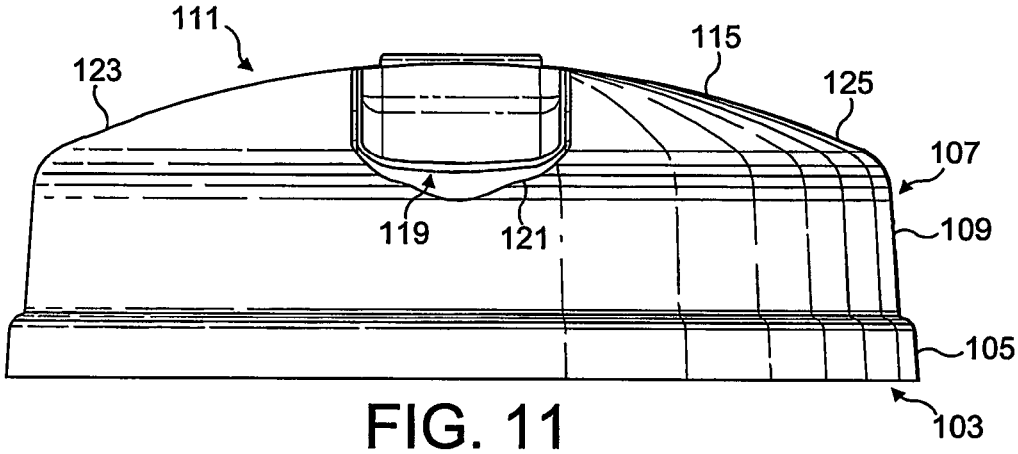
FIG. 11 illustrates another side view of the lid of FIG. 9.
Figure 12:
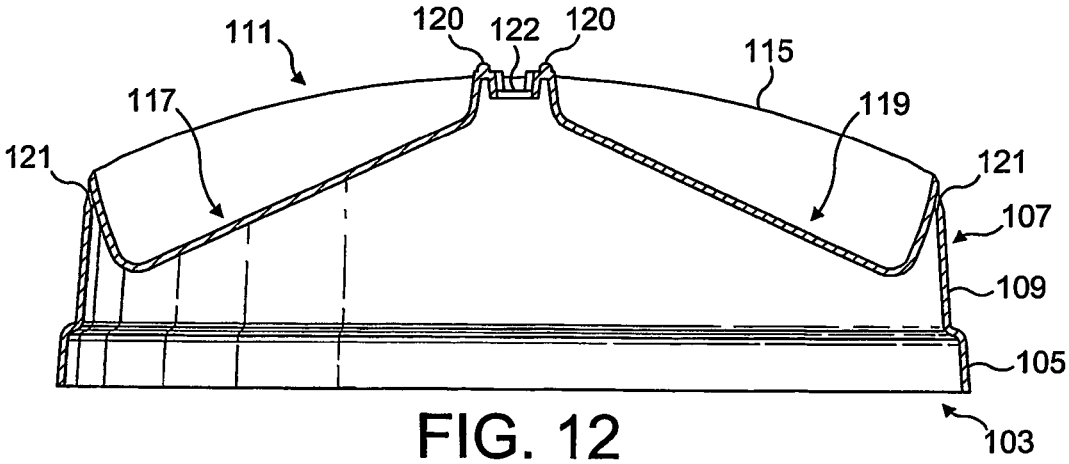
FIG. 12 illustrates a side sectional view (along section II-II) of the lid of FIG. 9.

In one modification, as illustrated in FIG. 8, the wing members 17, 19 and the slot 22 in the body section 15 can be offset from the center of the lid 3 in a direction opposed from the drinking spout 23. This configuration allows for a cup to which the lid 3 is fixed to be tilted to a greater degree.

The lid 103 comprises an annular flange 105 which is configured, in this embodiment dimensioned, to be a tight, sealing fit with the upper rim of an open-topped cup which contains a beverage product such as to prevent leakage at the junction of the flange 105 and the cup, and a body unit 107 which is formed integrally with the flange 105 and encloses the cup.

In this embodiment the lid 103 is formed from a plastics material, with the material being determined according to the beverage product. In a preferred embodiment the lid 103 is vacuum formed.

In this embodiment the body unit 107 comprises an annular wall member 109, a lower edge of which is formed with the flange 105, and a closure member 111 which extends inwardly of an upper edge of the wall member 109, here generally parallel to the flange 105, and encloses the cup.

In this embodiment the wall member 109 has a height such that the beverage bag of a beverage bag unit can be maintained clear, or at least substantially clear, of the beverage product contained by the cup when full, as will become apparent hereinbelow.

The closure member 111 comprises a body section 115 and first and second wing members 117, 119 which are hingeable about respective hinges 120, in this embodiment resilient connections, to the body section 115 such as to allow a user to squeeze the beverage bag when raised from the beverage product. In this embodiment the junction of the wing members 117, 119 to the body section 115 at other than the respective hinges 120 is by a perforated connection 121, which connection 121 is broken on operation of the wing members 117, 119 by a user.

The body section 115 includes a slot 122, in this embodiment centrally thereof, through which the drawstring of a beverage bag unit is threaded. In this embodiment the slot 122 is configured such as to allow the tab on the drawstring to be threaded therethrough. This configuration advantageously allows beverage bag units to be attached to lids 103 either at the time of manufacture or as and when required at service points. Also, as a result of the drawstring being a free, sliding fit in the slot 122, a user can repeatedly dunk the beverage bag into the beverage liquid where a strong infusion is required.

The body section 115 further includes a drinking spout 123 at one edge thereof through which a user drinks the beverage product as contained in the cup.

In one embodiment, for example, where the beverage product is a hot product, the body section 115 can include a caution notice warning of the same, which notice can be vacuum formed into the body section 115 where the lid 103 is vacuum formed.

The wing members 117, 119 are hinged, in this embodiment to a central region of the body section 115, such that on operating the same, the wing members 117, 119 are hinged in opposite senses and encompass the beverage bag when located therebetween. In this embodiment the wing members 117, 119 are recessed to receive ones of fingers or a finger and a thumb, typically a forefinger and a thumb, to allow for operation by squeezing the same.

The body section 115 further includes a drawstring locking element 125, in this embodiment a resilient tab formed integrally with the body section 115, which acts to lock the drawstring when located thereat, thereby enabling the beverage bag to be held in a position raised from the beverage product to prevent further infusion when standing, as will be described in more detail hereinbelow.

A typical operation of the lid 103 in relation to a beverage bag unit 133 will now be described hereinbelow by way of example with reference to FIGS. 13(*a*) to (*c*) of the accompanying drawings.

The beverage bag unit 133 comprises a beverage bag 135 which contains beverage material, a drawstring 137 which is connected to the beverage bag 135 and a tab 138 which is provided to the drawstring 137 to allow for a user to handle the beverage bag unit 133. It will be understood that the present invention finds application in relation to any bagged beverage product, which, for example, includes tea and flavourings. Also the beverage liquid can be hot or cold, and can be other than water, for example, milk. For the purposes of illustration, the operation of the lid 103 will be described in relation to a tea bag unit, where infused by hot water.

A cup 139 is first filled with a beverage liquid 141, in this embodiment a hot water.

The beverage bag unit 133, in this embodiment a tea bag unit, is then attached to the lid 103 by threading the tab 138 through the slot 122 in the body section 115. In one embodiment the lid 103 can be supplied with the beverage bag unit 133 already pre-threaded thereto.

Figure 13A:
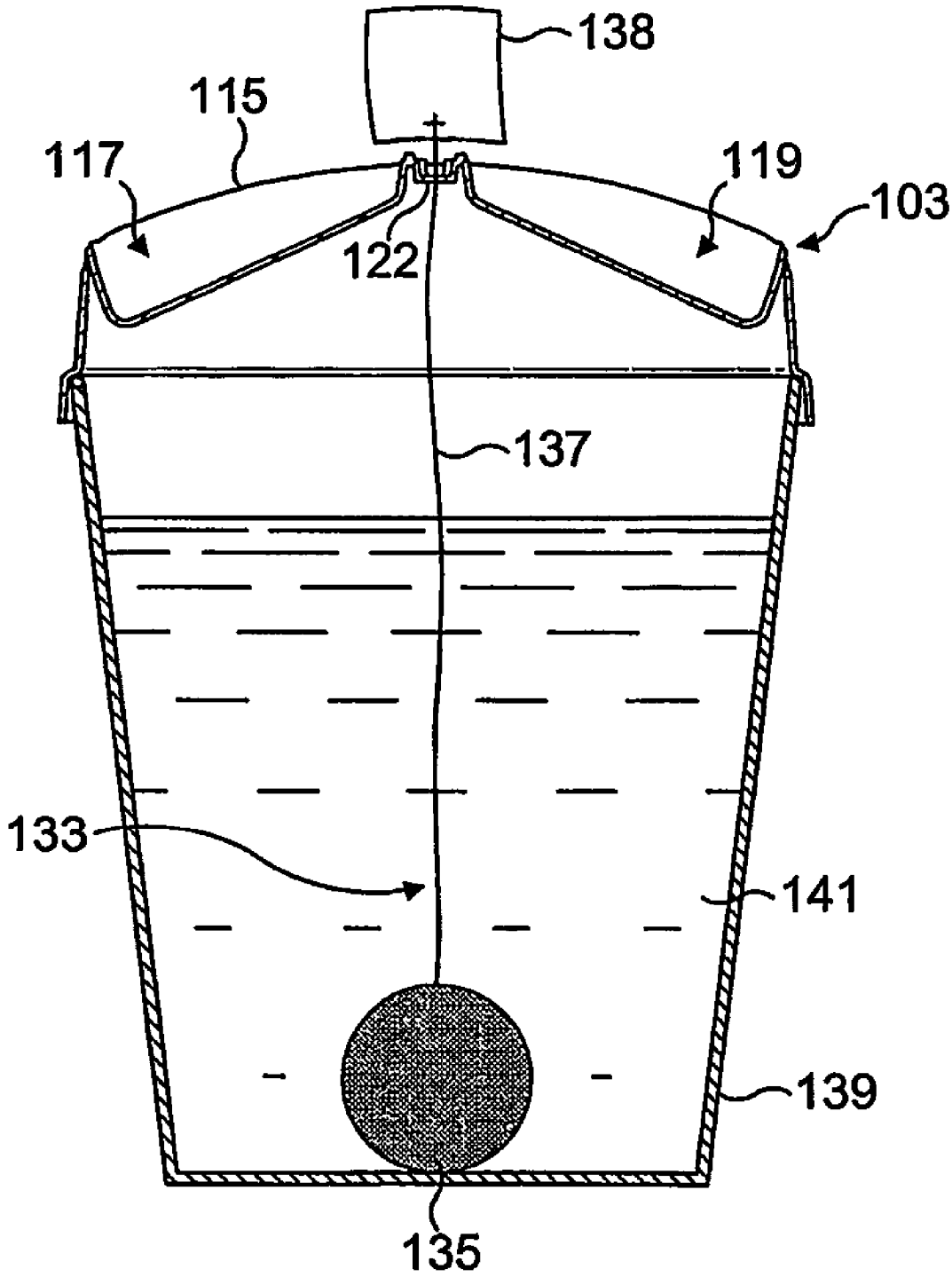
FIGS. 13(*a*) to (*c*) illustrate the operation of the lid of FIG. 8 in relation to a beverage bag unit.
Figure 13B:
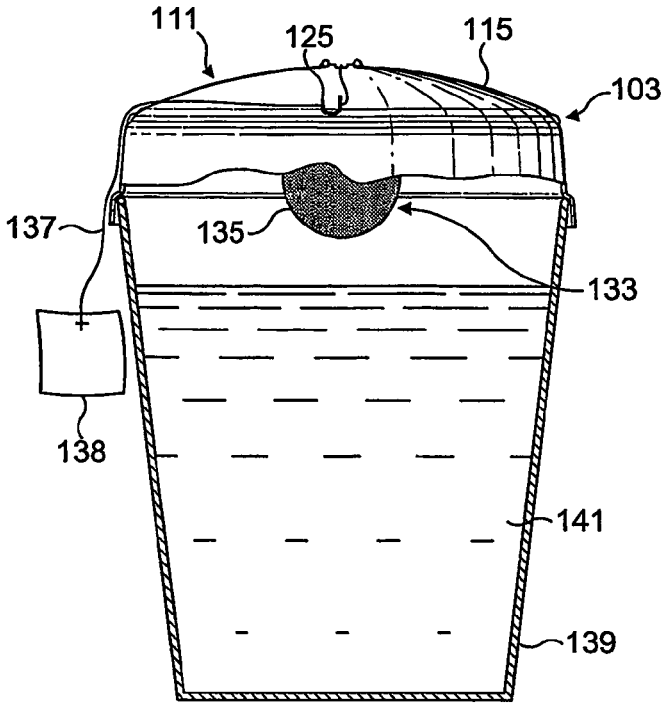
Figure 13C:
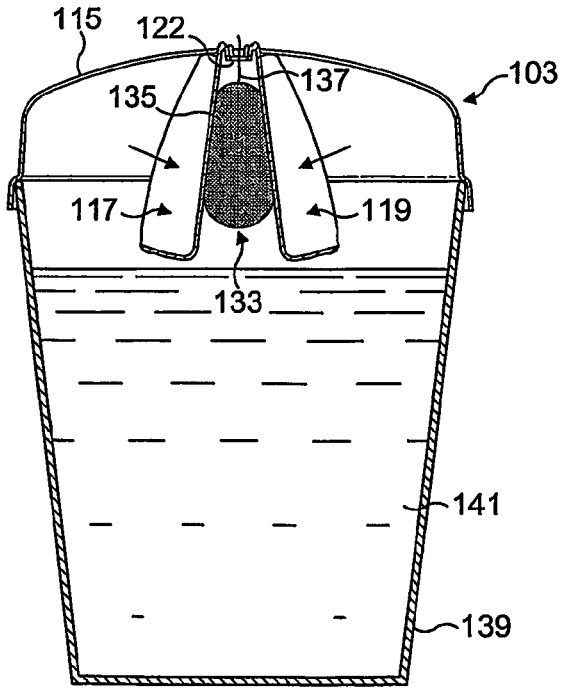

As illustrated in FIG. 13(*a*), the lid 103 is then fixed to the rim of the cup 139, whereupon the beverage bag 135 falls into the beverage liquid 141. The user can then dunk the beverage bag 135 as required to obtain a beverage product of-the required strength.

On attainment of a beverage product at the required strength, the user draws up the beverage bag by raising the tab 138 and locks the drawstring 137 at the drawstring locking element 125, in this embodiment by engaging the drawstring 137 underneath the drawstring locking element 125, such as to hold the beverage bag 135 clear of the beverage product and prevent further infusion, as illustrated in FIG. 13(*b*).

The user then operates on the wing members 117, 119 to squeeze the retained beverage liquid from the beverage bag 135, as illustrated in FIG. 13(*c*).

Finally, it will be understood that the present invention has been described in its preferred embodiments and can be modified in many different ways without departing from the scope of the invention as defined by the appended claims.

For example, in one modification where the fill level of the cup allows, the body unit 7, 107 need not include an annular wall member 9, 109.

In another modification, the drinking spout 23, 123 can be omitted, as some users may prefer to remove the lid 3, 103 and attached beverage bag unit following infusion, and thereby drink directly from the cup. Alternatively, a drinking spout may be formed by operation of a wing member.

In a further modification, the lid 3, 103 can include a ruptureable aperture to allow for use with a straw; the use of straws being particularly suited to cold beverages.

The invention claimed is:

1. A lid for a cup which provides for use of a beverage bag unit comprising a beverage bag and a drawstring connected to the beverage bag, said beverage bag being held beneath the lid within the cup, the lid comprising:

a flange for attachment to a cup; and a body unit comprising a body section including an aperture through which the drawstring is slideable, at least two wing members which are hinged to the body section and operable, with the lid fitted to the cup, by a finger and/or thumb of a user to allow the user to squeeze and/or hold the beverage bag when in a raised position, wherein at least one said wing member comprises an engagement element which can engage another such element when the wing member is in a hinged configuration such as to lock the wing member in a hinged configuration and thereby hold the beverage bag in a raised position, wherein the engagement elements of the wing members include counterpart engagement elements which engage one another when the wing members are in a hinged configuration such as to lock the wing members in the hinged configuration and thereby hold the beverage bag in the raised position.

2. The lid of claim 1, wherein the body unit comprises first and second wing members.

3. The lid of claim 1, wherein the flange is configured to provide a fluid-tight seal with a cup.

4. The lid of claim 1, wherein the aperture is sized such that the drawstring is freely slideable therein.

5. The lid of claim 1, wherein the beverage bag unit comprises a tab provided to the drawstring, and the aperture is sized such that the tab can be threaded therethrough.

6. The lid of claim 1, wherein the body section includes a drinking spout.

7. The lid of claim 1, wherein a wing member is operable to form a drinking spout.

8. The lid of claim 1, wherein at least one wing member is resiliently hinged to the body section.

9. The lid of claim 1, wherein the wing members are hinged to a central region of the body section such as to be hinged in opposite senses on operation of the same.

10. The lid of claim 1, wherein at least one wing member is attached to the body section by a hinge element about which the same is hinged on operation of the wing member, and a perforated connection which is broken on operation of the wing member.

11. The lid of claim 1, wherein at least one wing member is recessed such as to receive a finger and/or thumb of the user.

12. The lid of claim 1, wherein the engagement element on one wing member comprises a projection and the other such element comprises a recess, with locking being achieved by frictional engagement of the same.

13. The lid of claim 1, wherein the body unit includes a drawstring locking element which provides for locking of the drawstring when the beverage bag is in the raised position, such as to hold the beverage bag in the raised position.

14. The lid of claim 1, wherein the body unit comprises an upstanding wall member, a lower edge of which is connected to the flange, and a closure member which extends inwardly of an upper edge of the wall member and comprises the body section and the at least one wing member.

15. The lid of claim 1, wherein the lid is integrally formed.

16. The lid of claim 15, where the lid is vacuum formed from a plastics material.

17. The lid of claim 1, wherein the beverage bag unit comprises a tea bag unit.

* * * * *